US010605556B2

(12) United States Patent
Larson, Jr. et al.

(10) Patent No.: US 10,605,556 B2
(45) **Date of Patent: *Mar. 31, 2020**

(54) FIREARM

(71) Applicant: Rock River Arms, Inc., Colona, IL (US)

(72) Inventors: Lester C. Larson, Jr., Colona, IL (US); Joe Brown, Colona, IL (US); Matt White, Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 274 days.

This patent is subject to a terminal disclaimer.

(21) Appl. No.: 15/848,536

(22) Filed: Dec. 20, 2017

(65) Prior Publication Data

US 2018/0172381 A1 Jun. 21, 2018

Related U.S. Application Data

(63) Continuation of application No. 15/376,171, filed on Dec. 12, 2016, now Pat. No. 9,869,522.

(60) Provisional application No. 62/265,749, filed on Dec. 10, 2015.

(51) Int. Cl.

| | |
|---|---|
| ***F41A 19/16*** | (2006.01) |
| ***F41A 3/66*** | (2006.01) |
| ***F41A 17/46*** | (2006.01) |
| ***F41C 7/00*** | (2006.01) |

(52) U.S. Cl.

CPC ..... *F41A 19/16* (2013.01); *F41A 3/66* (2013.01); *F41A 17/46* (2013.01); *F41C 7/00* (2013.01)

(58) Field of Classification Search

CPC ..... F41A 19/16; F41A 19/17; F41A 19/10; F41A 19/14; F41A 19/31; F41A 17/46; F41A 17/82; F41A 3/66; F41C 7/00

See application file for complete search history.

(56) References Cited

U.S. PATENT DOCUMENTS

| | | | |
|---|---|---|---|
| 2,125,350 | A | 8/1938 | Loomis |
| 2,866,287 | A | 12/1958 | Ryan |
| 3,045,555 | A | 7/1962 | Stoner |
| 3,292,492 | A | 12/1966 | Sturtevant |
| 3,301,133 | A | 1/1967 | Sturtevant |
| 3,662,483 | A | 5/1972 | Seecamp |
| 4,575,963 | A | 3/1986 | Ruger et al. |
| 5,183,959 | A | 2/1993 | McCoan et al. |
| 5,251,533 | A | 10/1993 | Layton |
| 5,501,134 | A | 3/1996 | Milazzo et al. |
| 5,623,114 | A | 4/1997 | Soper |
| 5,713,150 | A | 2/1998 | Ealovega |
| 5,760,328 | A | 6/1998 | Robbins |
| 5,996,266 | A | 12/1999 | Orozco |
| 6,131,324 | A | 10/2000 | Jewell |
| 6,256,918 | B1 | 7/2001 | Szabo |
| 6,615,527 | B1 | 9/2003 | Martin |
| 6,718,680 | B2 | 4/2004 | Roca et al. |
| 6,772,548 | B1 | 8/2004 | Power |
| 7,140,138 | B1 | 11/2006 | Laney et al. |

(Continued)

*Primary Examiner* — Benjamin P Lee

(74) *Attorney, Agent, or Firm* — Banner & Witcoff, Ltd.

(57) ABSTRACT

An improved trigger assembly for a firearm includes twin disconnectors that are each independently selectable and adjustable to provide different trigger pull weights. The trigger assembly may be operably controlled by the safety selector which defines several different shaped engaging surfaces that allow the operator to selectively choose which of the disconnectors to operate with the firearm.

19 Claims, 13 Drawing Sheets

(56) References Cited

U.S. PATENT DOCUMENTS

| | | | |
|---|---|---|---|
| 7,213,359 | B2 | 5/2007 | Beretta |
| 7,331,136 | B2 | 2/2008 | Geissele |
| 7,421,937 | B1 | 9/2008 | Gangl |
| 7,600,338 | B2 | 10/2009 | Geissele |
| 7,654,187 | B2 | 2/2010 | Hochstrate et al. |
| 8,047,119 | B2 | 11/2011 | Hochstrate et al. |
| 8,069,602 | B2 | 12/2011 | Geissele |
| 8,074,393 | B2 | 12/2011 | Geissele |
| 8,667,881 | B1 | 3/2014 | Hawbaker |
| 9,310,150 | B1 | 4/2016 | Geissele |
| 2002/0073593 | A1 | 6/2002 | Weldle |
| 2003/0070342 | A1 | 4/2003 | Baker et al. |
| 2005/0229462 | A1 | 10/2005 | McGarry |
| 2006/0150466 | A1 | 7/2006 | Hochstrate et al. |
| 2006/0207151 | A1 | 9/2006 | Gussalli Beretta |
| 2009/0188145 | A1 | 7/2009 | Fluhr et al. |

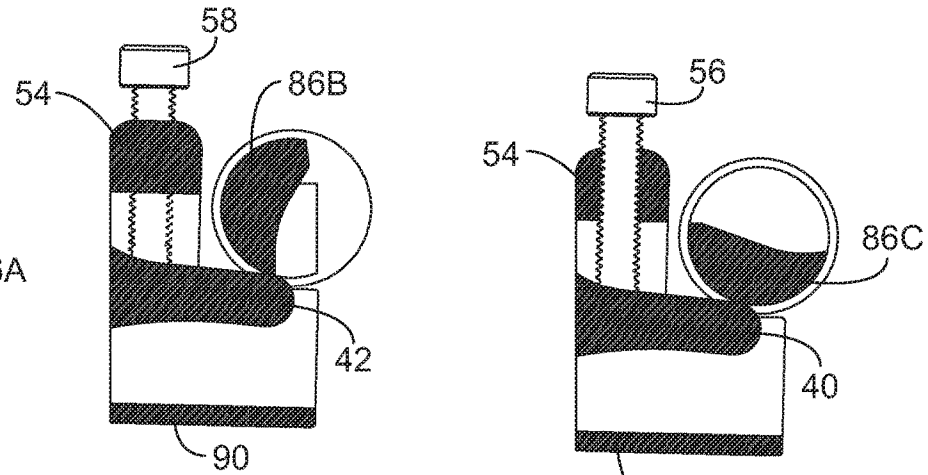
Figure 14B
Figure 14A
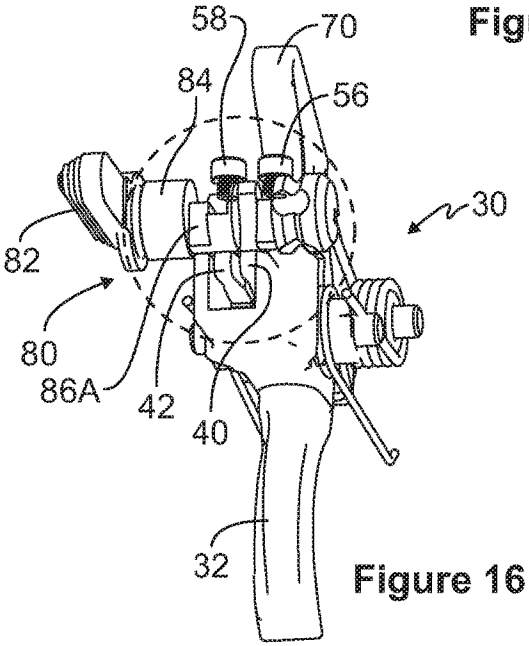
Figure 16
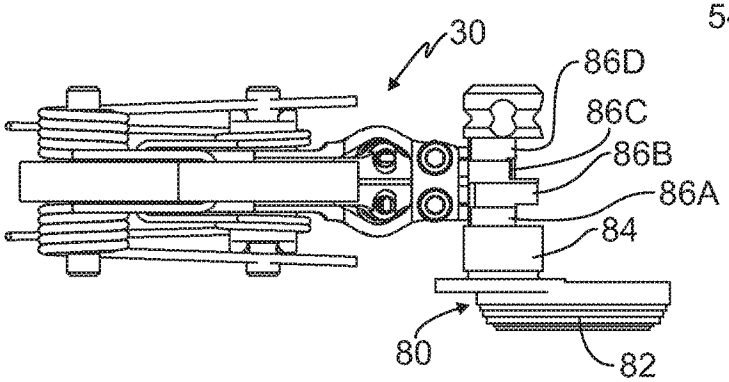
Figure 14
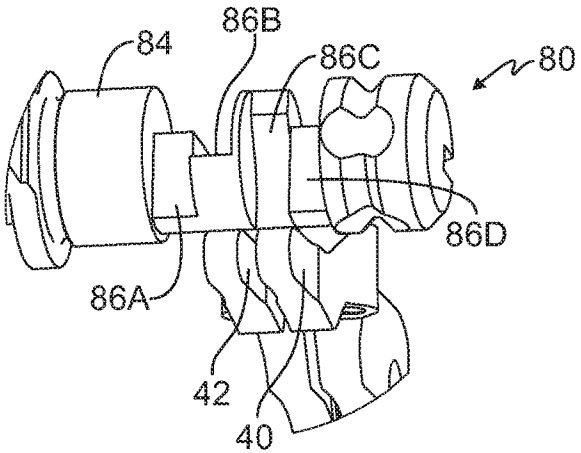
Figure 15

FIREARM

CROSS-REFERENCE TO RELATED APPLICATION

This application is a continuation of U.S. application Ser. No. 15/376,171, filed Dec. 12, 2016, which claims priority to U.S. Provisional Application No. 62/265,749, filed Dec. 10, 2015, which are expressly incorporated herein by reference in their entireties for any and all non-limiting purposes.

FIELD

The present invention relates generally to firearms and more particularly to a firearm having a unique trigger assembly.

BACKGROUND

It is known that firearms may include a single-stage or two-stage trigger assembly. A single-stage trigger generally means that once an operator pulls the trigger of the firearm there is one continuous motion through which the operator has to pull the trigger to release the hammer which then strikes the firing pin, which in turn discharges the round. A two-stage trigger generally means that as the operator pulls the trigger the trigger will progress through a first stage. Instead of the hammer releasing and striking the firing pin, the trigger will hit a stopping point that the operator will feel. This is the point between the first and second stages. Once the operator applies a little more pressure to the trigger the hammer will then release and will strike the firing pin.

The invention improves upon known firearms and specifically two-stage trigger assemblies for those firearms by providing a design that provides the operator with even greater selectivity and flexibility for all types of shooting conditions.

SUMMARY

The present invention is directed to an improved firearm that includes a two-stage trigger system with twin disconnectors that are each independently selectable and adjustable to provide different trigger pull weights. The exemplary twin spring-loaded disconnectors are operably controlled by the safety selector which defines several different shaped engaging surfaces that allow the operator to selectively choose which of the disconnectors will operate with the firearm. The different disconnector spring weights used with the disconnectors, and the operator-adjustable spring tensions of the springs used with the disconnectors, along with adjustments of the creep screws used to set the relative location of the disconnectors, allow for more operator control and adjustment of the trigger pull weight. This creates even greater selectivity, flexibility and benefits over existing firearms and known two-stage trigger assemblies and is advantageous for all types of shooting conditions, whether competition target shooting, hunting or combat situations.

DESCRIPTION OF DRAWINGS

The present invention is illustrated by way of example and is not limited in the accompanying figures in which like reference numerals indicate similar elements and in which:

FIG. 14 is a top view of the exemplary trigger assembly with the safety selector in safe mode.

FIG. 14A is a close-up view of the second disconnector with the safety selector engaging the second disconnector when the safety selector is in safe mode.

FIG. 14B is a close-up view of the first disconnector with the safety selector engaging the first disconnector when the safety selector is in safe mode.

FIG. 15 is an end view of the safety selector with the two disconnectors when the safety selector is in safe mode.

FIG. 16 is another end view of the safety selector with the two disconnectors when the safety selector is in safe mode.

DESCRIPTION OF THE EMBODIMENTS

Figure 1:
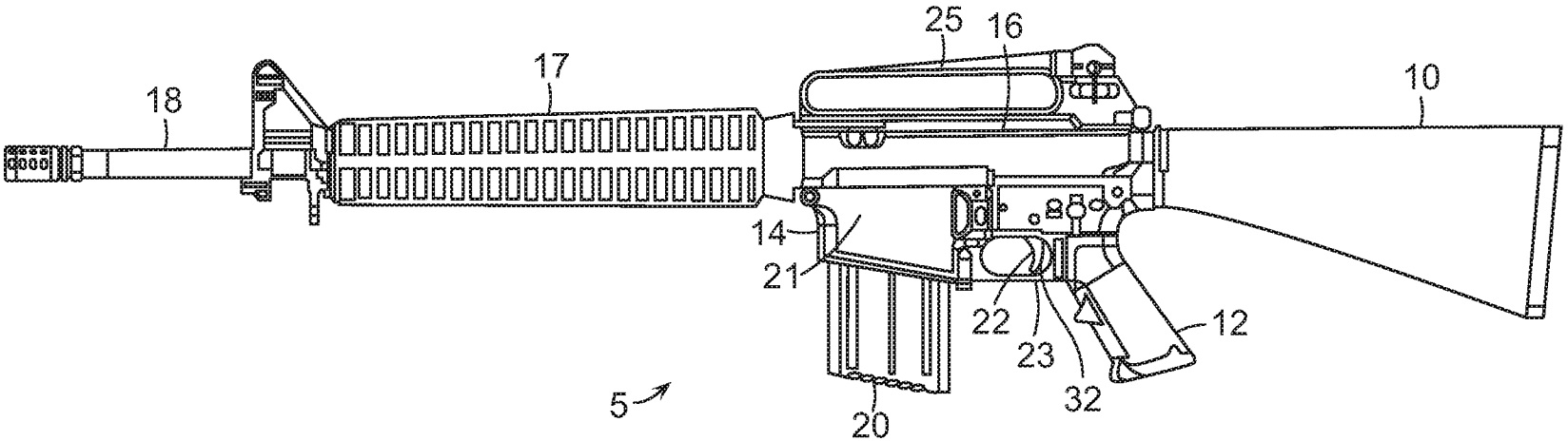
FIG. 1 illustrates a plan view of an exemplary firearm for use with the teachings of the invention.
Figure 2:
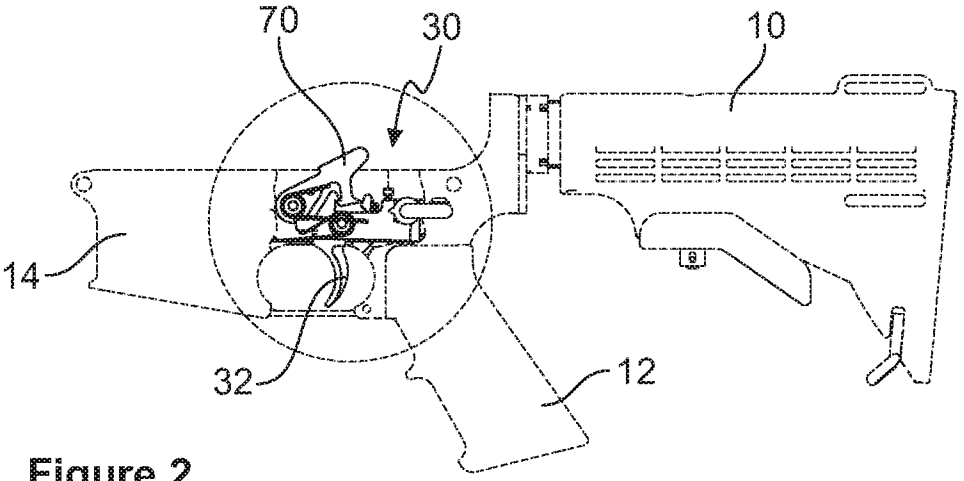
FIG. 2 is a side cut-away view of the firearm illustrating an exemplary trigger assembly.
Figure 3:
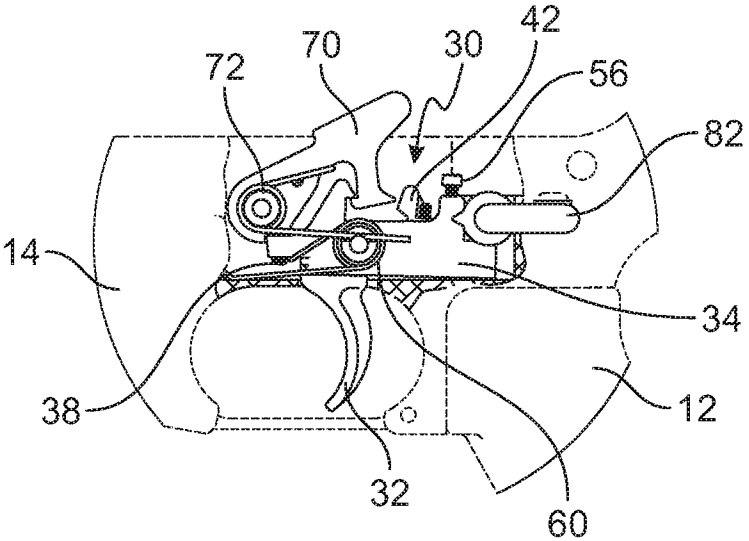
FIG. 3 is another side cut-away view of the firearm illustrating an exemplary trigger assembly.
Figure 5:
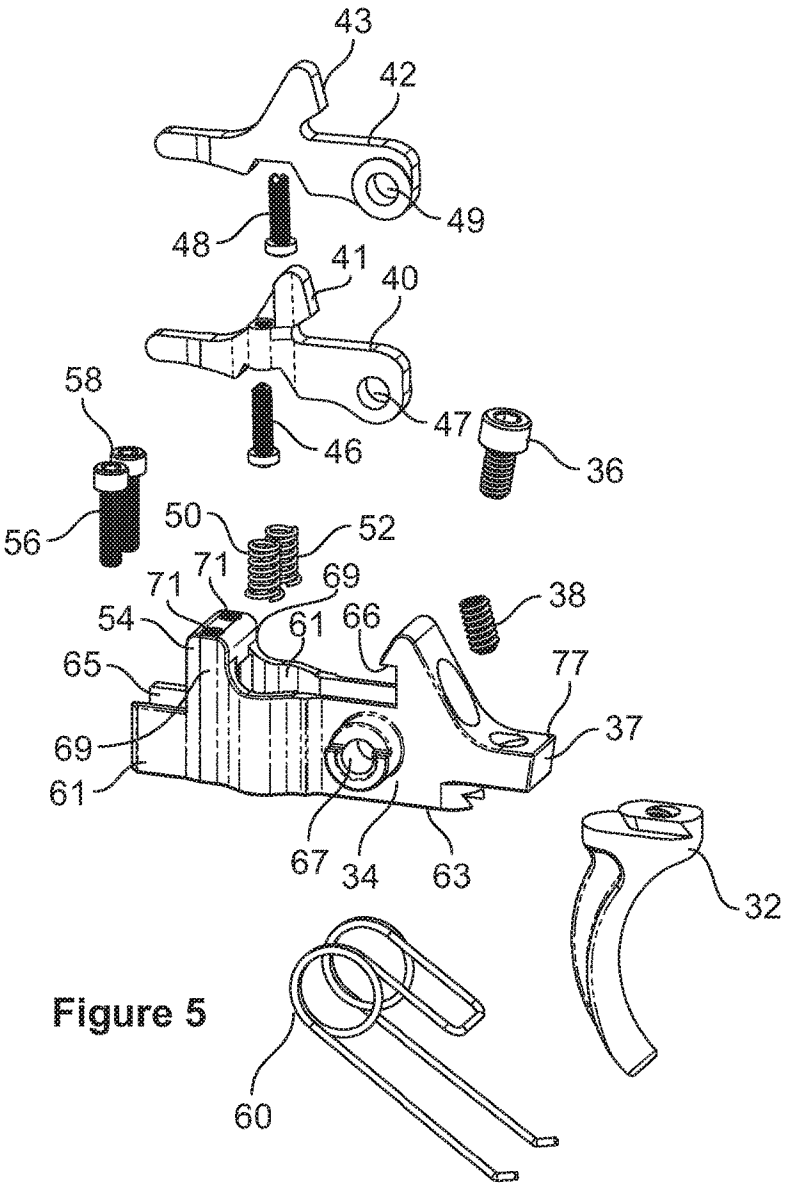
FIG. 5 is an exploded view of the exemplary trigger assembly of FIG. 4.
Figure 4:
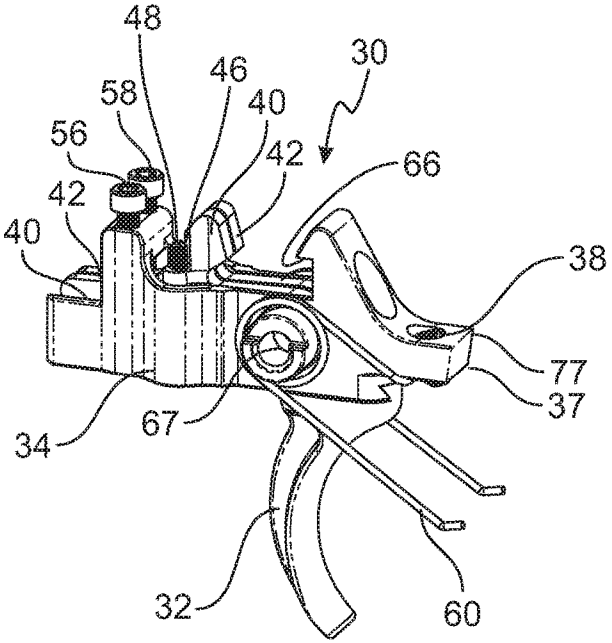
FIG. 4 is an isometric view of an exemplary trigger assembly.

Referring to FIGS. 1-34, the embodiments of the application are depicted. Referring to FIG. 1, the embodiments of the application include a firearm 5 that may include a lower receiver 14, an upper receiver 16 mounted to the lower receiver, a hand grip 12 mounted to the lower receiver, a handguard 17 mounted around a barrel 18, and a magazine well 21 formed in the lower receiver for receiving a magazine 20. The handguard 17 may be a mid-length handguard, CAR handguard, quad rail handguard, or other handguard. The barrel 18 may be chrome lined, chrome moly, aluminum or other suitable barrel type, and may be rifled or have a smooth bore. A stock 10 may be mounted to the back end of upper receiver 16. The stock 10 may be a fixed stock or may be an adjustable stock, such as a six-position tactical stock, or other suitable stock. A carry handle 25 or a picatinny rail may be included on the top side of upper receiver 16 for carrying the firearm or for mounting iron sights, optics and/or lights.

The firearm 5 may also include a trigger 22 and a trigger guard 23 that is pinned to the lower receiver and located between the magazine well and the hand grip. In an exemplary embodiment, the trigger may be a two-stage trigger assembly 30 incorporating adjustable twin disconnectors, as described herein. The firearm 5 may be in the form of a rifle, carbine or pistol, and may include the M-16, M-4, AR-15, and AR-10 family of rifles, among other rifle families. The firearm 5 may be semi-automatic or fully automatic. It should be understood that the two-stage trigger assembly 30 incorporating selectable and adjustable twin disconnectors, as described herein, may be used with any of these firearm types.

FIGS. 2-34 provide various views that depict an exemplary two-stage trigger assembly 30 that may be used with the firearm 5. As stated above and further explained below, the exemplary two-stage trigger assembly 30 may have selectable and adjustable twin spring-loaded disconnectors. The disconnectors may be operably controlled by the safety selector which defines several different shaped engaging surfaces that allow the operator to selectively choose which of the disconnectors to operate with the firearm.

As also explained below, the two-stage trigger assembly 30 may accept different disconnector spring weights. The disconnector springs can be set to a desired level of tension exerted on the disconnectors. Additionally, creep adjustment screws are used to set the location of the disconnector sear surfaces relative to the hammer sear surface. Also, an over-travel set screw is used to set the relative location of the disconnector sear surfaces, the hammer sear surfaces and the trigger sear. With the operator-selected positions of the disconnectors, the different disconnector spring weights, the operator-selected tensions of the disconnector springs, and the setting of the relative locations of the disconnector sear surfaces, the trigger sear and hammer sear surfaces, the two-stage trigger assembly as disclosed herein will allow for more operator control and adjustment of the trigger pull weight, as compared to existing trigger assemblies. Consequently, the two-stage trigger assembly of the invention creates even greater selectivity, flexibility and benefits with the firearm for all types of shooting conditions, including competition target shooting, hunting, or combat situations.

Referring to FIGS. 4, 5, 23, 24, the components of the trigger assembly 30 are illustrated. The trigger assembly 30 may include an interchangeable trigger pad 32. The trigger pad is configured to engage a trigger base 34. The trigger pad may slide onto the trigger base through a dovetail connection and may be secured to the trigger base through the use of a screw 36. The screw 36 may be used to permit the trigger pad to be moved forward or backward and then reset in place. Alternatively, the screw will permit the trigger pad to be removed and a different trigger pad to be mounted to the trigger base and then held in place by the screw.

The trigger base 34 is pinned to the lower receiver 14 through the trigger pin that extends through the trigger pin hole 67. The trigger base is allowed to rotate relative to the lower receiver 14. The trigger assembly 30 also includes a trigger spring 60 that is coiled around the trigger pin hole 67 to permit the trigger assembly to pivot around the trigger pin, not shown, and to force the trigger assembly 30 to rotate back to its original position once the trigger is no longer pulled.

Threaded to the trigger base 34 at a forward end 37 of the base is an over-travel set screw 38 that extends through the base at the forward end. The set screw 38 will extend through the trigger base and will be used to set the amount of trigger base rotation as the trigger pad is pulled. The set screw 38 is used to prevent over-travel of the trigger assembly 30, as further explained below. The forward end 37 defines an edge 77 that engages with a notch 81 formed in the hammer to help hold the hammer 70 in a cocked position prior to the trigger being pulled. The trigger base 34 defines a rearward end opposite the forward end.

The trigger assembly 30 may include first and second disconnectors 40, 42 that are mounted to the trigger base 34 and held to the trigger base through the use of the trigger pin which will pass through holes 47, 49 formed in the disconnectors. The first and second disconnectors 40, 42 include disconnector sear portions 41, 43, respectively. As explained below, the disconnector sear portions 41, 43 will serve as a contact surface for the hammer sear when the trigger pad is pulled to the end of the first stage. The disconnector sear portions 41, 43 each define an angled surface that permit the hammer second sear portion 74 to contact and slide along the surfaces and to allow the hammer second sear portion to push downwardly on the disconnector.

Figure 10:
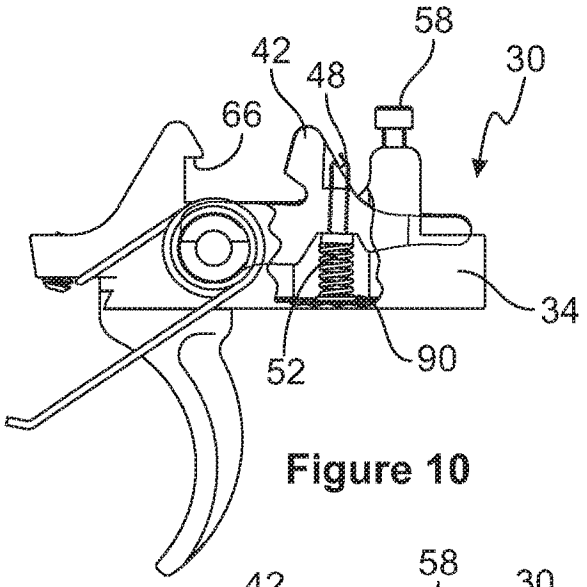
FIG. 10 is a side view illustrating an exemplary trigger assembly showing a cut-away view of the weight adjustment spring for a disconnector.
Figure 11:
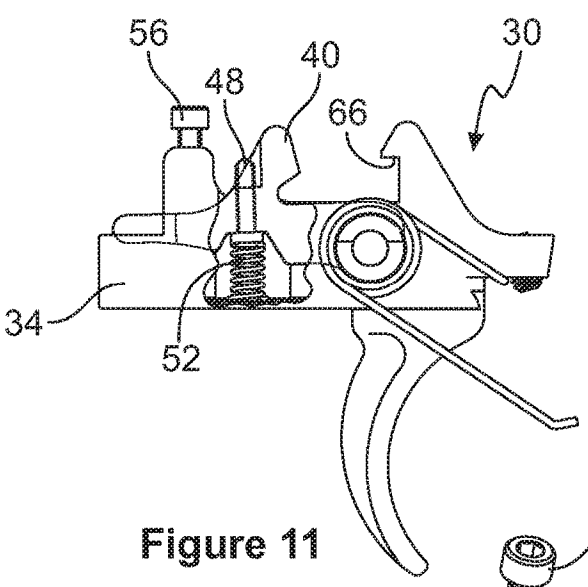
FIG. 11 is another side view illustrating an exemplary trigger assembly showing a cut-away view of the weight adjustment spring for a disconnector.
Figure 12:
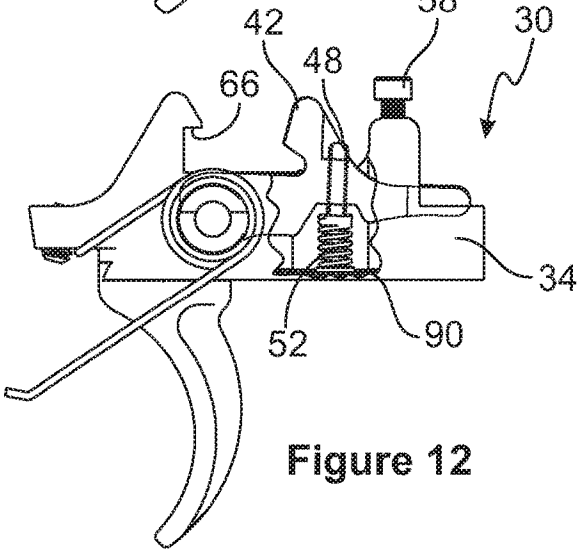
FIG. 12 is a side view illustrating an exemplary trigger showing a cut-away view of the weight adjustment spring for a disconnector after the spring is compressed.
Figure 13:
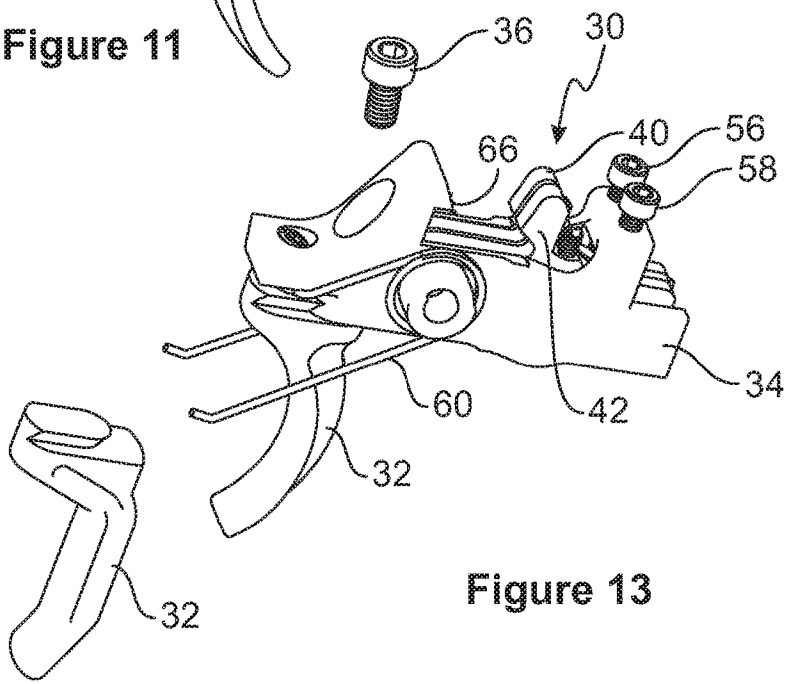
FIG. 13 is an isometric view of the exemplary trigger assembly showing a cut-away view of the weight adjustment spring for a disconnector.

The trigger assembly 30 further includes for each disconnector a disconnector spring adjustment screw 46, 48 and a coiled spring 50, 52. The spring adjustment screws 46, 48 extend upwardly through threaded holes in each disconnector, the threaded holes located behind the disconnector sear surfaces and further away from the holes 47, 49. The screws 46, 48 define screw heads extend downwardly toward the floor of the trigger base, as shown in FIG. 10. Each coiled spring is positioned between the screw head of each adjustment screw and the trigger base 34, as can be seen in FIGS. 10 and 12. The spring adjustment screw may be used to adjust the spring tension applied to the disconnector. The more the springs 50, 52 are compressed by the adjustment screw head, the greater the load applied to the disconnector. The ability to increase or decrease the spring load applied to the disconnectors provides the operator with greater adjustability of the trigger pull weight.

Comparing FIGS. 10 and 12, in FIG. 12 the screw is adjusted downwardly as compared to its position in FIG. 10. In this downward position, the screw head exerts a downward force on the spring, thereby compressing the spring and creating a higher spring load, thereby requiring a greater trigger pull force to overcome the higher spring load on the disconnector. The operator may choose from a number of different springs having different spring weights to provide additional and different spring loads on the disconnector. The disconnector screw and the numerous possible springs allow the operator to adjust the force required to rotate the disconnector and thus the force needed to pull the trigger through the second stage of the two-stage process. And with the use of two disconnectors with each having different spring weights and different settings of the spring forces, the teachings of the application provide numerous possible settings for and the selective adjustment of the trigger pull weight during the second stage. In some embodiments, the total pull weight for both stages can be in a range from about 2 lbs. to 6 lbs. In other embodiments, the total pull weight may be in a range from about 3 lbs. to about 5 lbs.

The end of the coiled spring opposite the end contacting the screw head may seat in a machined recess formed in the floor of the trigger base 34, as shown in FIGS. 10 and 12. Again, the coiled spring 50, 52, which will seat in the machined recess, may be any number of different springs each having different weights and spring forces to provide the trigger assembly 30 with varying trigger pull weights.

Threaded to the top of the trigger base 34 through a top bridge 54 are creep adjustment screws 56, 58. Each creep adjustment screw 56, 58 is used to adjust the relative position of the disconnector to which it is operably connected. The creep adjustment screw can be used to set the position of the sear portions 41, 43 of the respective disconnectors, each of which may be selectively contacted by the hammer's second sear surface 74 (shown in FIG. 7) which begins the second stage of the two-stage trigger process, as explained below. This adjustment of the relative location of the disconnector and hammer sear surface provides the operator with still further adjustability of the trigger pull.

The creep adjustments screws 56, 58 allow the operator to adjust the location of the first stage stop point when the hammer second sear portion or surface 74 contacts the disconnector. The creep adjustment screws also control the amount of overlap remaining between the hammer first sear portion 68 and the trigger sear portion 66. By adjusting the creep adjustment screw, the disconnector sear surface 41, 43 can be positioned nearer or farther away from the hammer second sear portion 74 making the contact point nearer or farther away from the edge of the disconnector sear surface. As indicated, this will also adjust the amount of overlap between the hammer first sear 68 and the trigger sear 66. Each creep adjustment screw is independently adjustable to provide a different setting for the first and second disconnectors, thereby providing further adjustability of the trigger pull weight.

The trigger base 34 also includes the trigger sear portion 66 that, as explained below, will contact and engage the hammer's first sear portion 68 when the hammer is in a first position. In one embodiment, the first position is when the hammer is in the cocked position. The trigger sear portion 66 is located at the forward end 37 of the trigger base and extends upwardly from the forward end. The trigger sear 66 defines a hook shape that extends toward the rearward end of the trigger base. The hook shape defines the trigger sear portion 66. The trigger base 34 defines opposing side walls 61 extending upwardly from a trigger floor 63 and between which form a trigger pocket 65. Opposing columns 69 extend upwardly from the side walls. The opposing columns are joined by a transversely extending top bridge 54 that extends over and above the trigger pocket, and over and above the disconnectors. The bridge 54 serves to join the opposing columns and defines a pair of spaced apart threaded holes 71 wherein the threaded holes receive the threaded creep adjustment screws 56, 58 that extend downwardly toward and in contact with the disconnectors. Again, the creep adjustment screws set the position of the disconnectors relative to the trigger base and relative to the hammer and specifically the hammer second sear portion.

Figure 7:
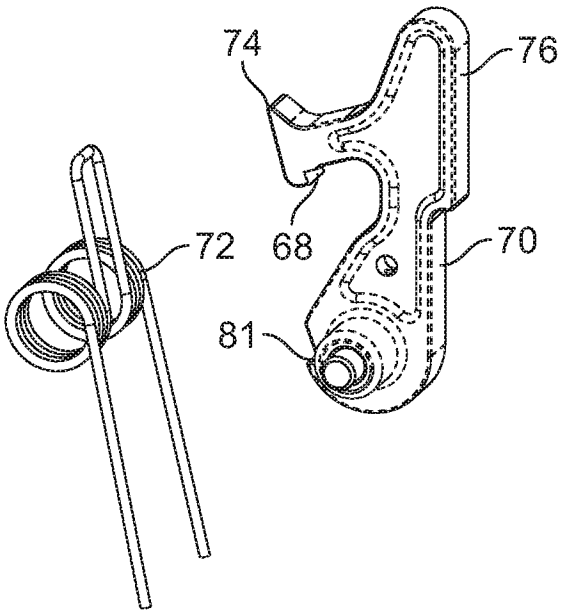
FIG. 7 is an exploded view of the exemplary hammer assembly of FIG. 6
Figure 6:
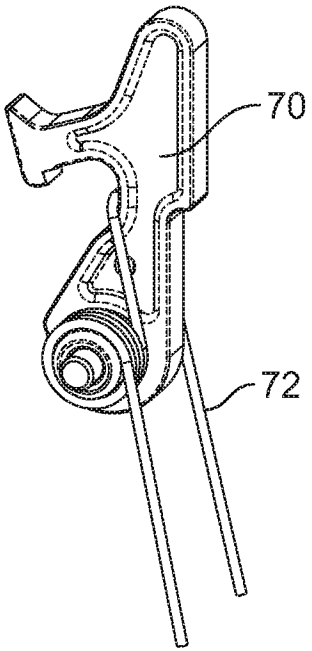
FIG. 6 is an isometric view of an exemplary hammer assembly used with the exemplary trigger assembly.

As shown in FIGS. 6 and 7, the firearm 5 includes a hammer 70 and a hammer spring 72 both mounted to the lower receiver. The hammer is pivotally mounted to the lower receiver forward of the mounting of the trigger assembly. The hammer spring exerts a torsional force on the hammer causing it to move in a rotational direction toward and into contact with the firing pin. The hammer can move from a first position to a second position. The hammer includes a hammer first sear portion 68 that engages the trigger sear portion 66, and a hammer second sear portion 74 that contacts one of the disconnector sear portions 41, 43 after the trigger is pulled a certain distance to complete the first stage. The hammer also defines a hammer head portion 76 that in operation is the portion of the hammer that will strike the firing pin once the trigger assembly completes the second stage. The hammer further defines a notch 81 that will engage the edge 77 of the trigger base 34 thereby holding the hammer in the cocked position prior to the trigger being pulled.

Referring to FIGS. 14-25, the safety selector 80 may define a lever 82 and a pin 84 that extends from one side of the lower receiver 14 to the other side. The pin of the safety selector may define multiple engaging surfaces 86A, 86B, 86C, 86D, as can be seen in FIGS. 14-19, which provide for bearing contact with the first and second disconnectors when the selector is in safe mode, and for selective non-bearing contact when the safety selector lever is moved to a different position, such as fire mode or the third mode. The multiple engaging surfaces 86A, 86B, 86C, 86D are positioned adjacent to each other along the pin 84. As can be seen in the figures, the engaging surfaces define arcuate surfaces that are specifically shaped to provide the proper bearing contact and to permit room for the disconnectors to move when the engaging surfaces are not engaged with the disconnectors. In one embodiment, one engaging surface may be configured such that it is rotated approximately 90 degrees relative to an adjacent engaging surface. In one embodiment, FIG. 15 illustrates a view of the exemplary arcuate or curve-shaped engaging surfaces on the safety selector pin that may be used to achieve the teachings and benefits of the invention. These surfaces are specifically designed and shaped to accomplish the multi-stage trigger operation of the embodiments of the application. Other shapes of the engaging surfaces are possible with the invention.

In the safe mode, the engaging surfaces 86A-D provide a diameter that causes the first and second disconnectors to stay under the pin 84 (FIGS. 14 and 23-25). In this position, the engaging surfaces thus prevent either of the disconnectors from rotating toward engagement with the hammer second sear portion. This keeps the firearm in a mode where the firearm is unable to discharge a round when pulling on the trigger. FIGS. 14A and 14B depict enlarged cross-section views of the pin at the location where each disconnector would contact the pin to illustrate how both disconnectors are kept underneath the pin thereby keeping the firearm in safe mode.

Figure 17B:
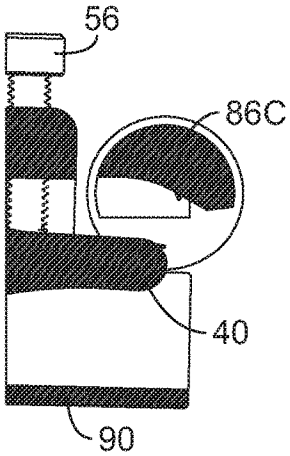
FIG. 17B is a close-up view of the first disconnector with the safety selector not engaging the first disconnector to permit its movement when the safety selector is in fire mode.
Figure 17A:
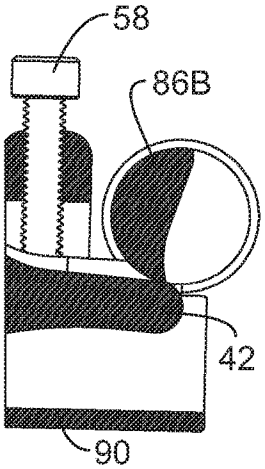
FIG. 17A is a close-up view of the second disconnector with the safety selector engaging the second disconnector to prevent its movement when the safety selector is in fire mode.
Figure 17:
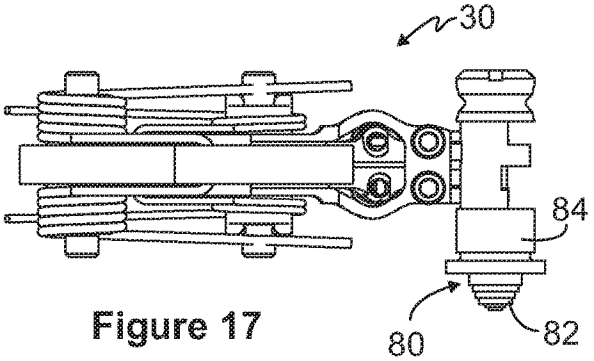
FIG. 17 is a top view of the exemplary trigger assembly with the safety selector in fire mode.
Figure 19:
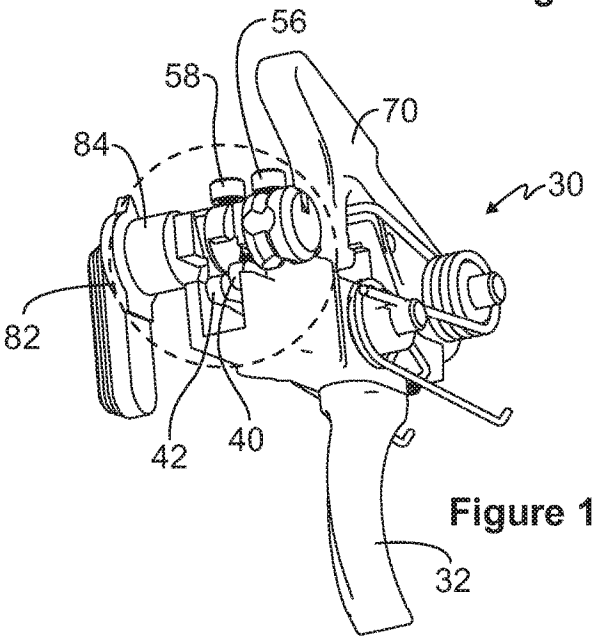
FIG. 19 is an isometric view of the safety selector with the two disconnectors when the safety selector is in fire mode.
Figure 18:
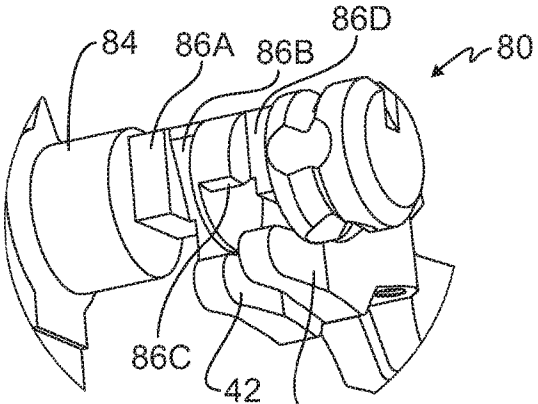
FIG. 18 is an end view of the safety selector with the two disconnectors when the safety selector is in fire mode.

Referring to FIGS. 17-19, when the safety selector 80 is rotated to a second mode, such as a fire mode, the engaging surface 86C no longer bears against the first disconnector 40 thereby allowing the first disconnector to move upward and engage the hammer second sear portion, as explained below, while the engaging surface 86B remains in contact with the second disconnector 42 holding it down and out of the way so that only the first disconnector 40 engages with the hammer second sear portion.

FIGS. 17A and 17B show enlarged cross section views of the safety selector pin 84, engaging surfaces 86B, 86C, and the disconnectors 40, 42. As can be seen in FIG. 17A, disconnector 42 is shown held down underneath the safety selector pin engaging surface 86B and cannot move to engage the hammer second sear portion. As can be seen in FIG. 17B, the other disconnector 40 is shown to be able to freely move upward yet still underneath the safety selector pin engaging surface 86C and the sear portion of the disconnector can rotatably move to engage the hammer second sear portion. As illustrated by the cross-section of the pin in FIG. 17B, the shape and configuration of the engaging surface 86C permits a gap or spacing to exist between the engaging surface 86C and the disconnector.

Figure 20B:
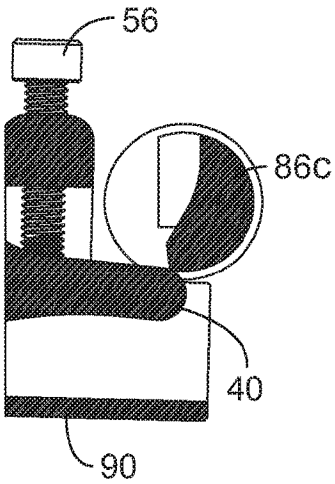
FIG. 20B is a close-up view of the first disconnector with the safety selector engaging the first disconnector to prevent its movement when the safety selector is in the third mode.
Figure 20A:
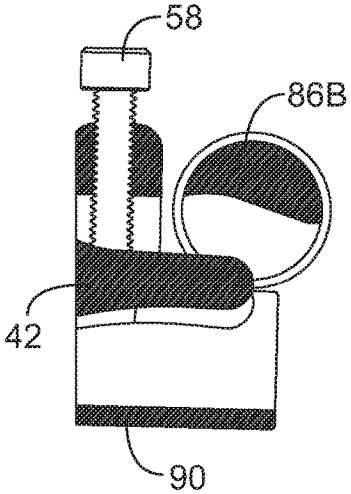
FIG. 20A is a close-up view of the second disconnector with the safety selector not engaging the second disconnector to permit its movement when the safety selector is in the third mode.
Figure 22:
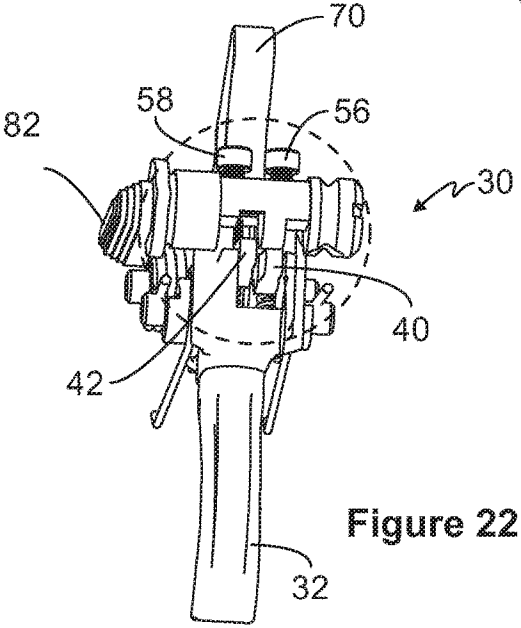
FIG. 22 is an isometric view of the safety selector with the two disconnectors when the safety selector is in the third mode.
Figure 20:
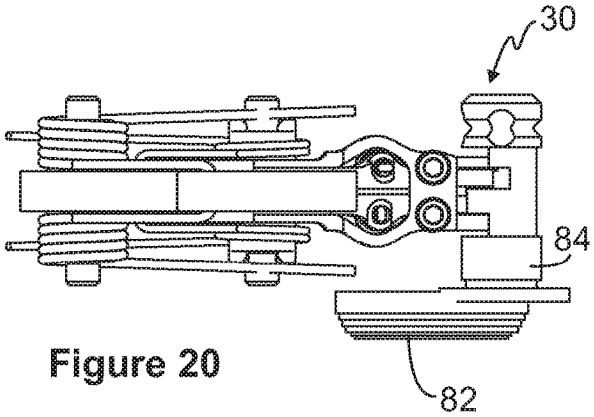
FIG. 20 is a top view of the exemplary trigger assembly with the safety selector in a third mode.
Figure 21:
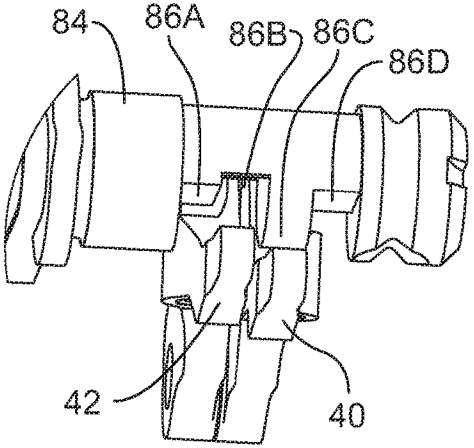
FIG. 21 is an end view of the safety selector with the two disconnectors when the safety selector is in the third mode.
Figure 25:
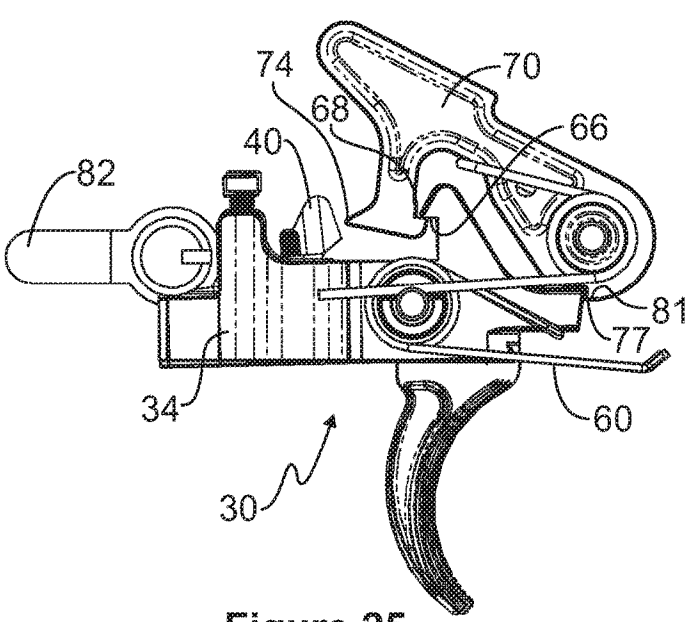
FIG. 25 is a side view of the trigger assembly when the safety selector is in safe mode.
Figure 24:
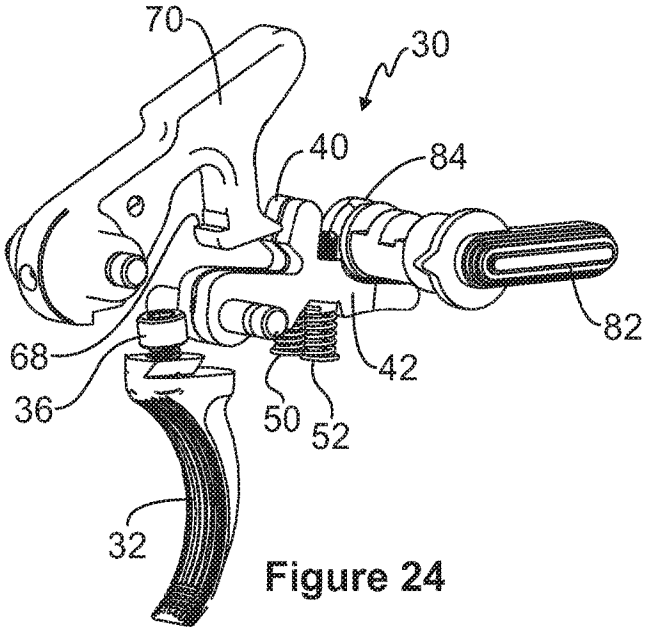
FIG. 24 is an isometric view of the trigger assembly when the safety selector is in safe mode and without the trigger pocket.
Figure 23:
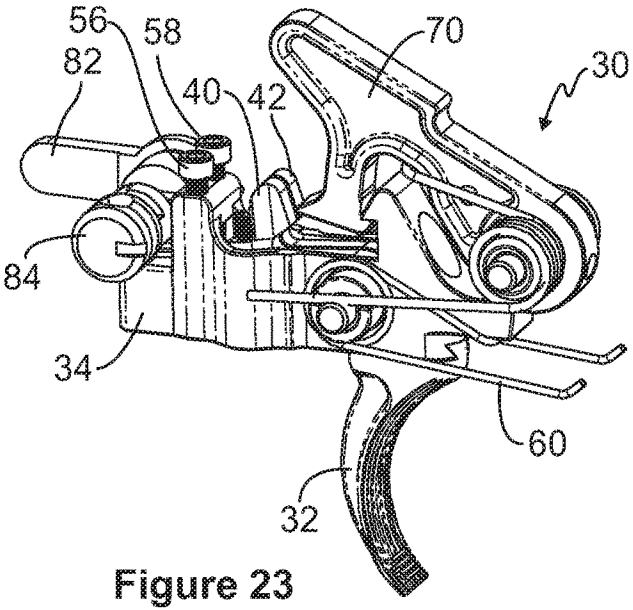
FIG. 23 is an isometric view of the trigger assembly when the safety selector is in safe mode.

Referring to FIGS. 20-22, when the safety selector is rotated to a third mode that is 90 degrees from the second mode (or fire mode), in other words, 180 degrees from the first mode, the engaging surface 86B no longer bears against the second disconnector 42 thereby allowing this disconnector to move and engage with the hammer second sear portion, while the engaging surface 86C now is positioned on top of and remains in contact with the disconnector 40 thereby preventing its movement toward the hammer second sear portion. FIGS. 20A and 20B further illustrate the two different engaging surfaces. FIG. 20A shows the engaging surface 86B creating a space or gap to allow, in this case, the second disconnector 42 to engage the hammer second sear portion. The spacing or gap can be more clearly seen in FIG. 21. The shape and configuration of the engaging surface 86B is what permits a spacing or gap to exist between the engaging surface 86B and the disconnector 42. FIG. 20B shows the engaging surface 86C engaging the first disconnector 40 holding it down and keeping the disconnector from engaging the hammer second sear portion. Again, FIG. 21 more clearly shows how the engaging surface 86C holds down the first disconnector 40 preventing it from moving.

In operation, by pulling the trigger pad 32, the trigger assembly 30, including the trigger base and disconnectors, will rotate about the trigger pivot pin and will start to pull the trigger sear portion 66 off the hammer first sear portion 68. It will also cause the edge 77 of the trigger base to slide relative to the notch 81 formed in the hammer. Also, when the trigger is pulled thereby rotating the trigger assembly about the trigger pivot pin the resistance of the trigger spring is overcome. The trigger is pulled until the hammer second sear portion contacts one of the disconnectors. This movement causes the overlap or amount of contact between the hammer first sear portion and the trigger sear portion to be reduced to the point where only a minimal amount of overlap remains. It also reduces the overlap between the edge 77 and the notch 81. Once the hammer second sear portion contacts one of the disconnectors, at this point the operator will feel a stop. This is considered the end of the first stage of the two-stage trigger process. At this point, the second sear portion of the hammer tries to rotate one of the disconnectors around the trigger pivot pin. An additional amount of pressure is needed from pulling the trigger to overcome the spring force of the disconnector to cause the disconnector to rotate downwardly around the trigger pivot pin. It is desired that this additional amount of pressure be minimal to cause movement of the disconnector which will consequently cause continued rotation of the hammer. Once the hammer rotates a minimal additional amount, the trigger sear portion will slip off the hammer first sear portion thereby allowing the hammer to rotate rapidly under the force of the hammer spring to a second hammer position and strike the firing pin. This will then discharge the firearm. This slight additional pull on the trigger is considered the second stage of the trigger pull process.

Figure 28:
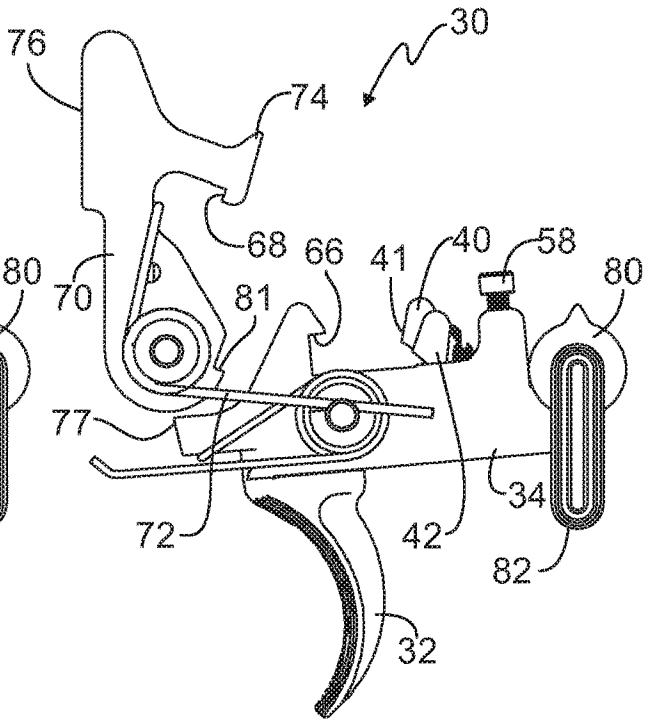
FIG. 28 is another side view of the trigger assembly when the safety selector is in fire mode and when the trigger is pulled further so that the hammer releases from the trigger sear, completing stage two of the two-stage process.
Figure 27:
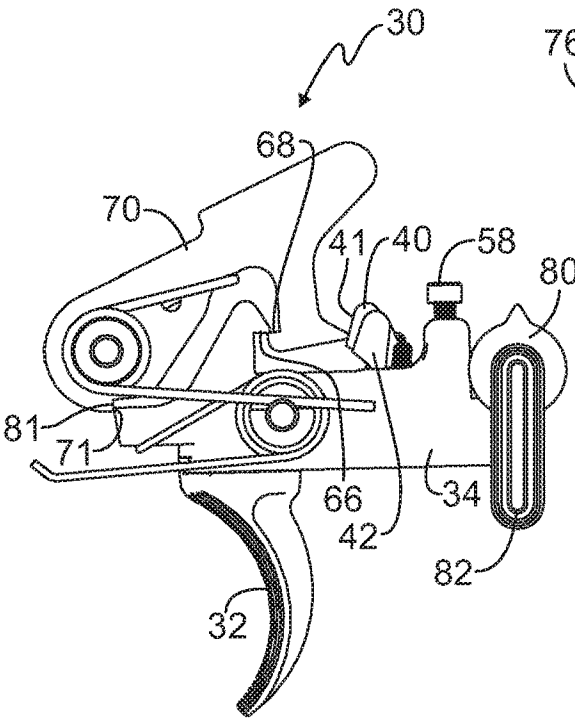
FIG. 27 is another side view of the trigger assembly when the safety selector is in fire mode and the first disconnector is allowed to engage the hammer, completing stage one of the two-stage process.
Figure 26:
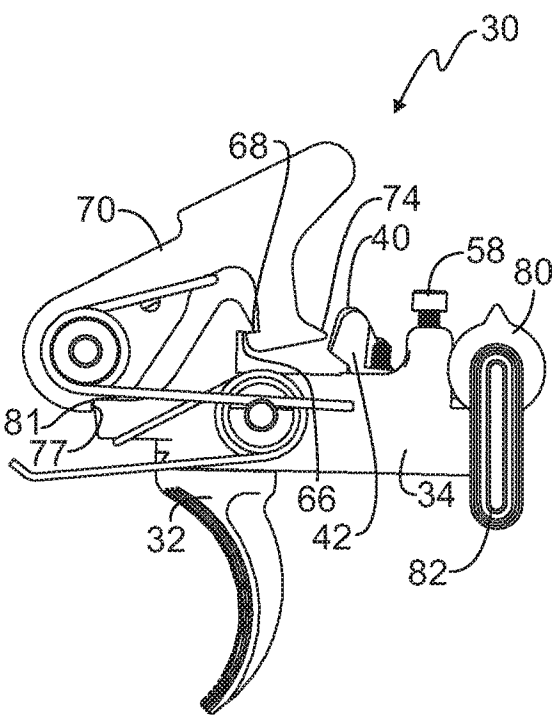
FIG. 26 is a side view of the trigger assembly when the safety selector is in fire mode.

As indicated, the hammer second sear portion 74 will contact one of the sear portions 41, 43 of one of the disconnectors 40, 42, depending on the setting of the safety selector 80. Referring to FIGS. 26-28, the sequence of steps of the two-stage trigger of the embodiments of the application is depicted. In FIG. 26, the trigger assembly is shown in a resting position with the safety selector positioned in the fire position. In this position and with respect to this particular embodiment, the first disconnector 40 is engaged to operate with the hammer second sear portion 74. The second disconnector 42 is held down by an engaging surface of the safety selector. The first disconnector 40 can be seen in a forward position relative to the second disconnector and will be the disconnector contacted by the hammer second sear portion during stage two of the two-stage trigger process. The hammer first sear portion can be seen to overlap the trigger sear portion. The edge 77 of the trigger base 34 can be seen receiving the notch 81 of the hammer thereby holding the hammer in the cocked position.

Referring to FIG. 27, as the trigger is pulled, the entire trigger assembly rotates around the trigger pivot pin and the trigger sear portion 66 begins to slide off the hammer first sear portion 68 to the point where there is minimal overlap and thus minimal contact between the trigger sear portion and the hammer first sear portion. The notch 81 of the hammer also begins to slide off the edge 77 of the trigger base 34 where there is minimal overlap and thus minimal contact between these two surfaces. The trigger assembly will rotate until the hammer second sear portion 74 contacts the first disconnector 40 and more specifically the sear portion 41 of the first disconnector 40. This is considered the end of stage one of the two-stage trigger operation. At this point, the operator will feel a definitive stop.

Referring to FIG. 28, as the trigger is pulled further to start the second stage, the hammer second sear portion 74 presses down on the sear surface 41 of the first disconnector 40 overcoming the spring force applied to the disconnector and causing the first disconnector to rotate around the trigger pivot pin and down and away from the hammer second sear portion 74. The amount of force to overcome the disconnector spring force can be adjusted by installing a different weight disconnector spring and by adjusting the disconnector spring screw which sets the disconnector spring tension. As shown in this figure, as the operator continues to pull the trigger, the hammer second sear portion overcomes the first disconnector spring force and the trigger sear portion 66 continues to slide off the hammer first sear portion 68 to the point where there is no overlap between the two portions. There is also no overlap between the notch 81 of the hammer and the edge 77 of the trigger base 34. At this point, the hammer 70 is free from the trigger sear 66 and edge 77 and the hammer is allowed to rotate freely. The hammer spring then rapidly rotates the freed hammer head 76 portion toward the firing pin to contact the firing pin and thus discharge the firearm.

Figure 31:
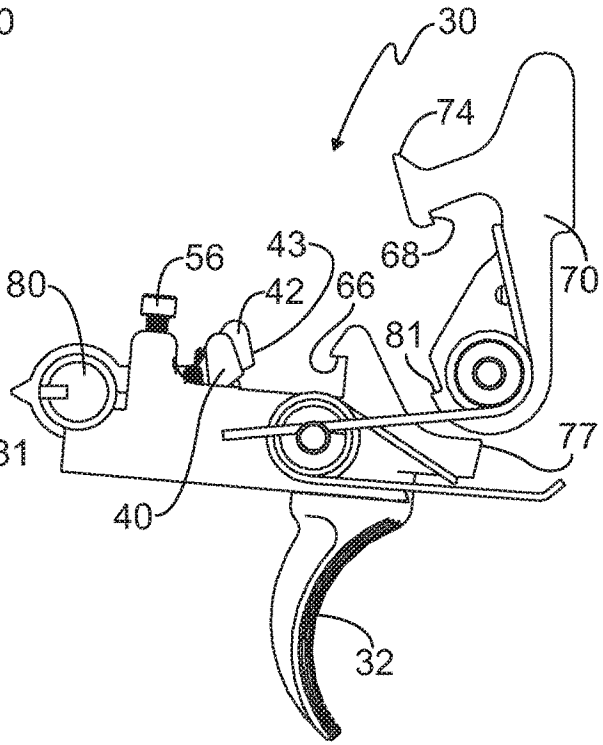
FIG. 31 is another side view of the trigger assembly when the safety selector is in the third mode and when the trigger is pulled further so that the hammer releases from the trigger sear, completing stage two of the two-stage process.
Figure 30:
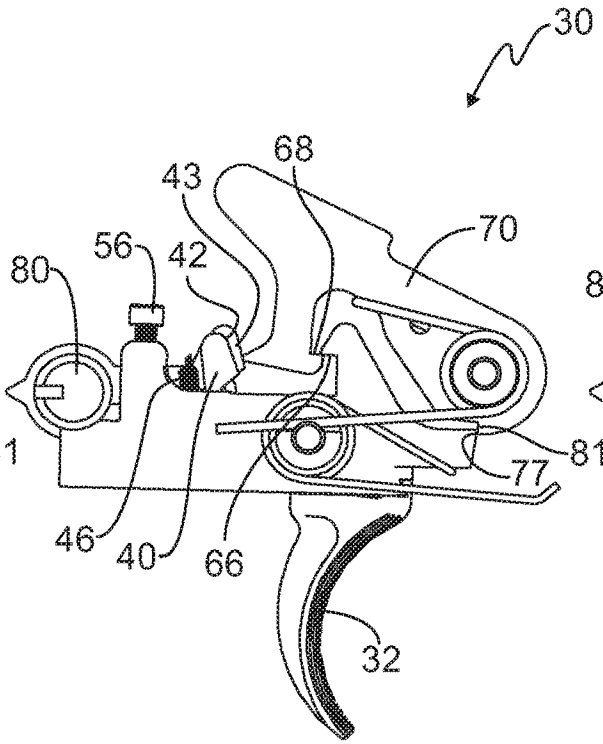
FIG. 30 is another side view of the trigger assembly when the safety selector is in the third mode and the second disconnector is allowed to engage the hammer, completing stage one of the two-stage process.
Figure 29:
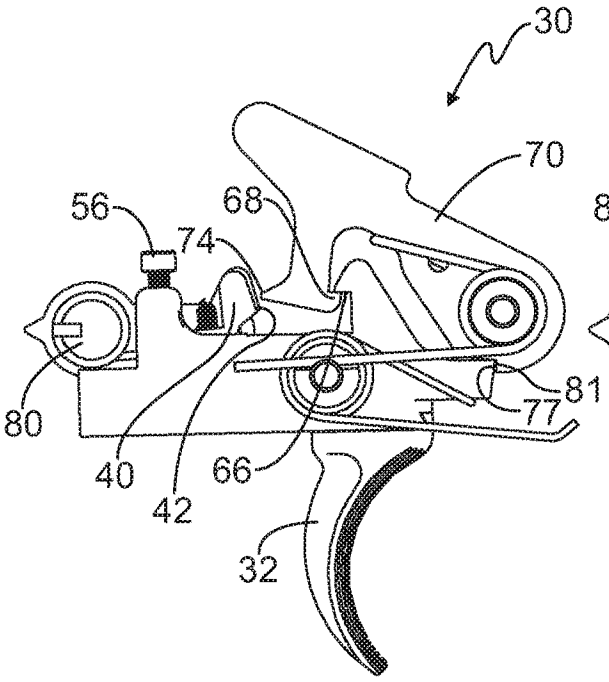
FIG. 29 is a side view of the trigger assembly when the safety selector is in the third mode.
Figure 34:
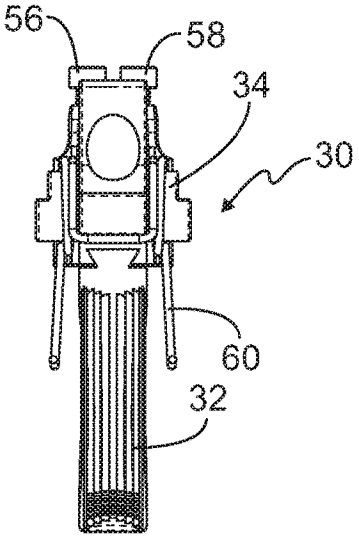
FIG. 34 is an end view of the trigger assembly of FIG. 4.
Figure 32:
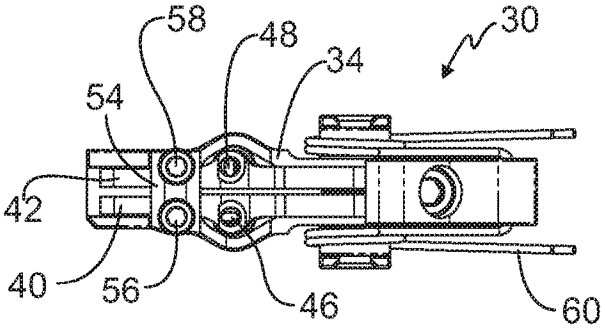
FIG. 32 is a top view of the trigger assembly of FIG. 4.
Figure 33:
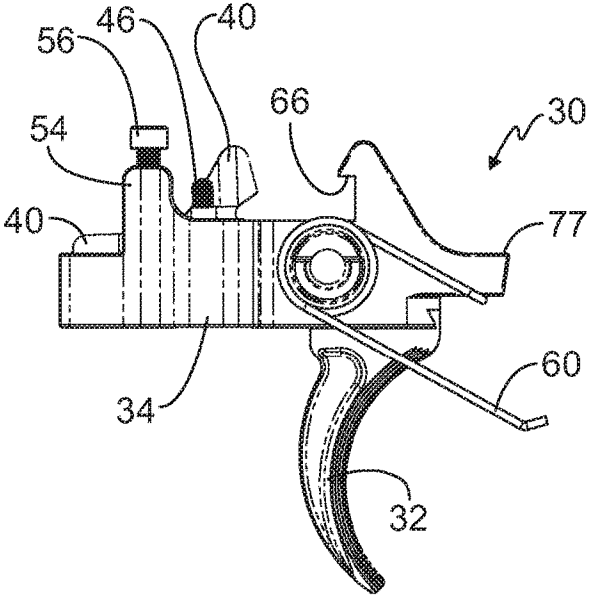
FIG. 33 is a side view of the trigger assembly of FIG. 4.

Referring to FIGS. 29-31, with the embodiments of the application, the operator can rotate the safety selector lever to a third mode position that is 90 degrees from the fire mode and is 180 degrees from the safe mode position to cause the second disconnector 42 to be engaged with the hammer second sear portion while the first disconnector 40 becomes held down by the safety selector. In this position, when the operator pulls the trigger, the above described sequence will be repeated but with the sear surface 43 of the second disconnector 42 being contacted by the hammer second sear portion 74. The first disconnector 40 will not be contacted by the hammer second sear portion because it is held down and away from the hammer second sear by the engaging surfaces of the safety selector. The second disconnector may be equipped with a disconnector spring having a weight different than the spring weight of the first disconnector spring. Additionally, the disconnector spring screw can be set to provide more or less spring tension. Depending on the second disconnector spring being used and the amount of spring force provided by the spring, more or less pull force will be required to overcome the spring force than the pull force needed to overcome the first disconnector spring. Thus, the two-stage trigger assembly can be equipped with two different weighted disconnector springs and each can be set to different spring tensions to allow greater customized trigger pull weight and to allow the operator to select which pull weight it wants to use by simply rotating the safety selector to a particular position which will engage either the first or second disconnector.

With the teachings of the application it is contemplated that more than two disconnectors could be used with the trigger assembly 30. It is contemplated that by narrowing the width of the disconnector more than two disconnectors could possibly be used within the confines of the trigger assembly space. For example, it is possible that three, four and possibly more disconnectors could be used with the embodiments of the application to provide even further selection and adjustment of the trigger pull weight.

As indicated, each disconnector can be set to a desired spring force that must be overcome during the second stage. For example, if a greater trigger pull weight is desired, one disconnector may include a heavier spring that will require a greater pull force to overcome the greater spring force. Conversely, if a lighter trigger pull weight is desired, the other disconnector may include a lighter spring that will require a lighter trigger pull force to overcome the lighter spring force. The operator is able to select which disconnector to use by adjusting the safety selector which, as explained herein, includes multiple engaging surfaces that will permit one or the other disconnector to engage. Consequently, with the embodiments of the application, the second stage pull force can be customized by the operator and independently selected depending on the type of shooting, whether competition target shooting, hunting or combat situations.

Figure 8C:
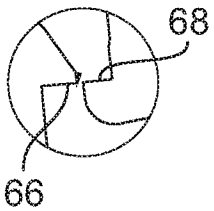
FIGS. 8A-8C are close-up views of the over-travel screw when not in contact with the bottom of the trigger pocket, and the trigger is obstructed by the safety.
Figure 8B:
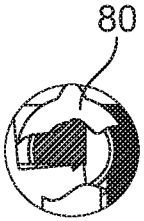
Figure 8A:
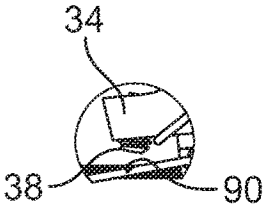
Figure 9C:
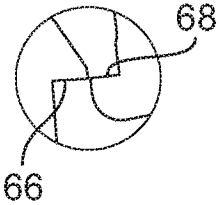
FIGS. 9A-9C are close-up views of the over-travel screw when it is in contact with the bottom of the trigger pocket, and the trigger is not obstructed by the safety.
Figure 9B:
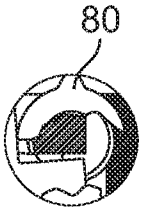
Figure 9A:
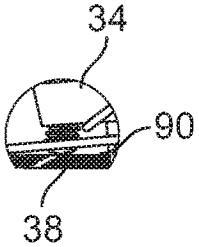
Figure 8:
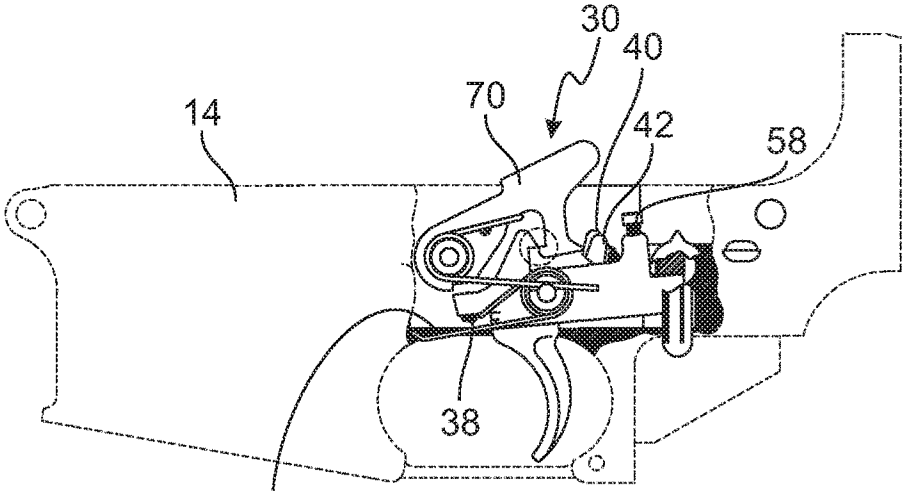
FIG. 8 is a side cut-away view illustrating an exemplary trigger assembly when the over-travel screw does not contact the bottom of the trigger pocket.
Figure 9:
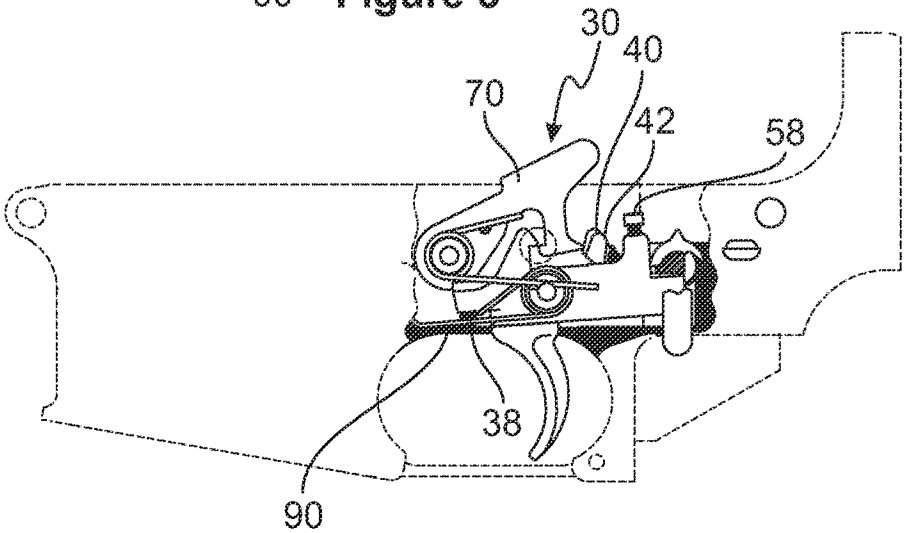
FIG. 9 is a side cut-away view illustrating an exemplary trigger assembly when the over-travel screw is in contact with the bottom of the trigger pocket.

Referring to FIGS. 8 and 9, the over-travel set screw 38 extends through the front end of the trigger assembly. This set screw sets the amount of over-travel of the trigger assembly after the hammer 70 breaks free from the disconnector and strikes the firing pin to discharge the round. In its initial mounted setting, there is a gap or space between the end of the set screw and the base 90 of the lower receiver pocket, as shown in FIG. 8A. If there is too much of a gap between the end of the set screw and the base 90, the trigger could potentially be obstructed by the safety selector 80, as illustrated in FIG. 8B. Also, the set screw can be used to set the relative spacing between the trigger sear 66 and the hammer sear 68, as illustrated in FIG. 8C. After the trigger is pulled and the hammer breaks free, the trigger assembly will rotate and travel only until the over-travel set screw 38 contacts the base of the lower receiver pocket where it will stop, as shown in FIG. 9A. As illustrated in FIG. 9B, the gap between the end of the set screw and the base 90, if set correctly, is such that the trigger is not obstructed by the safety selector 80. Also, if the gap is set correctly, the relative spacing between the trigger sear 66 and the hammer sear 68 is negligible, as illustrated in FIG. 9C, so that when the hammer is released from the trigger sear, the set screw immediately contacts the base of the lower receiver pocket thus stopping any further rotation of the trigger assembly.

It is desirable to minimize the amount of over-travel of the trigger assembly after the hammer is released. The less over-travel, the less distance the operator's trigger finger must move forward for the trigger assembly to reset so that the trigger can then be pulled again to discharge another round, when the firearm is in semi-automatic mode. Additionally, excessive over-travel and reset distances may fatigue the operator's trigger finger, especially in high round count situations, e.g., during competitive shooting, and will reduce the rate of fire for the firearm when in semi-automatic mode.

In one exemplary embodiment, the invention includes a firearm that includes, among other features, a lower receiver that defines a pocket formed between opposing walls of the lower receiver. The firearm further includes an upper receiver mounted to the lower receiver, a barrel mounted to the upper receiver, a handguard mounted around the barrel, and a hand grip mounted to the lower receiver. A magazine well is formed in the lower receiver for receiving a magazine. The firearm also includes a hammer mounted to the lower receiver and movable between a first position and a second position. The hammer defines a hammer first sear surface and a hammer second sear surface. A safety selector is mounted to the lower receiver and is movable between a first position, a second position, and a third position. The safety selector defines a lever accessible from a side of the lower receiver and a pin that extends perpendicularly from the lever and extends between opposing walls that define the lower receiver. The pin defines a first engaging surface and a second engaging surface. The firearm includes a trigger assembly positioned in the lower receiver pocket and is mounted to the lower receiver by a trigger pin. The trigger assembly is rotatable about the trigger pin and through a first stage and a second stage.

With the exemplary embodiment, the trigger assembly defines a trigger base having a forward end and a rearward end. The trigger base defines a trigger sear extending upwardly from the forward end. The trigger sear defines a hook shape that extends toward the rearward end of the trigger base. In operation, the trigger sear engages the hammer first sear surface when the hammer is in the first position. The trigger assembly also includes an over-travel set screw mounted to the forward end of the trigger base and extends through the trigger base and into the lower receiver pocket. The trigger assembly further includes a first disconnector and a second disconnector both of which are mounted to the trigger pin. The first disconnector defines an aperture through the disconnector for receiving a first threaded screw, and the second disconnector also defines an aperture through the disconnector for receiving a second threaded screw. Each of the first and second threaded screws defining a screw head. A first disconnector spring is positioned between the screw head of the first threaded screw and a floor of the trigger base. A second disconnector spring is positioned between the screw head of the second threaded screw and the floor of the trigger base. The first disconnector defines a first disconnector sear surface and the second disconnector defines a second sear surface. The trigger base also defines opposing side walls extending upwardly from the trigger base floor and opposing columns extending upwardly from the side walls. The opposing columns are joined by a transversely extending bridge that extends over and above the first and second disconnectors. The bridge defines a pair of spaced apart threaded holes that receive threaded screws that extend downwardly toward and in contact with the disconnectors positioned beneath the bridge. The threaded screws set the position of the disconnectors relative to the hammer second sear surface.

With the exemplary embodiment, and in operation, when the safety selector of the firearm is in the first position, the first engaging surface of the pin is in contact with the first disconnector thereby preventing movement of the first disconnector and the second engaging surface of the pin is in contact with the second disconnector thereby preventing movement of the second disconnector. When the safety selector is moved to the second position, the first engaging surface of the pin is in contact with the first disconnector thereby preventing movement of the first disconnector and the second engaging surface of the pin is not in contact with the second disconnector thereby permitting movement of the second disconnector. In the second position, the second disconnector sear surface will contact the hammer second sear surface when the trigger assembly is pulled thereby completing the first stage. Also in the second safety selector position, when the trigger assembly is pulled during the second stage, the hammer second sear surface will force the second disconnector downwardly overcoming the spring force of the second disconnector spring until the point where the hammer first sear surface no longer engages the trigger sear thereby completing the second stage. At this point the hammer will then rotate to the second position. When the safety selector is moved to a third position, the first engaging surface of the pin is not in contact with the first disconnector thereby permitting movement of the first disconnector and the second engaging surface of the pin is in contact with the second disconnector thereby preventing movement of the second disconnector. The first disconnector sear surface will contact the hammer second sear surface when the trigger assembly is pulled thereby completing the first stage. And when the trigger assembly is pulled during the second stage, the hammer second sear surface will force the first disconnector downwardly overcoming the spring force of the first disconnector spring until the point where the hammer first sear surface no longer engages the trigger sear thereby completing the second stage. At this point the hammer will then rotate to the second position.

The exemplary firearm also includes a hammer that further defines a notch and the trigger base defines an edge at the forward end of the trigger base. In operation, the edge of the trigger base engages the notch of the hammer when the hammer is in the first position. At the end of the second stage the edge of the trigger base disengages the notch of the hammer, thereby permitting the hammer to move to the second position. The exemplary firearm further includes an over-travel set screw that is mounted to the forward end of the trigger base and will contact a base of the lower receiver pocket immediately after the trigger assembly is rotated through the second stage, thereby stopping further rotation of the trigger assembly and preventing over travel of the trigger assembly.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A trigger assembly for a firearm comprising:

a hammer defining a hammer first sear surface and a hammer second sear surface, a trigger mountable to the firearm by a trigger pin, the trigger rotatable around the trigger pin through a first stage and a second stage, the trigger defining a trigger base having a floor, a forward end and a rearward end, the trigger base defining a trigger sear extending upwardly from the forward end, the trigger sear defining a hook shape that extends toward the rearward end of the trigger base, wherein the trigger sear is capable of engaging the hammer first sear surface, a first disconnector and a second disconnector both mountable to the trigger pin, the first disconnector defining an aperture through the disconnector for receiving a first threaded screw, the second disconnector defining an aperture through the disconnector for receiving a second threaded screw, a first disconnector spring positioned between the first threaded screw and the floor of the trigger base, a second disconnector spring positioned between the second threaded screw and the floor of the trigger base, wherein the first disconnector defines a first disconnector sear surface and the second disconnector defines a second disconnector sear surface, wherein the trigger base defines opposing side walls and opposing columns extending upwardly from the trigger base floor, the opposing columns joined by a transversely extending bridge that extends over and above the first and second disconnectors, the bridge defining a pair of spaced apart threaded holes, wherein the threaded holes receive threaded screws that extend downwardly toward and in contact with the disconnectors positioned beneath the bridge, wherein the threaded screws set the position of the disconnectors relative to the hammer second sear surface.

2. The trigger assembly of claim 1, further comprising a safety selector mountable to the firearm, the safety selector movable between a first position, a second position, and a third position.

3. The trigger assembly of claim 2, wherein the safety selector defines a lever accessible from a side of the firearm, the safety selector including a pin extending across and above the first and second disconnectors.

4. The trigger assembly of claim 3, wherein the pin defines a first engaging surface and a second engaging surface.

5. The trigger assembly of claim 4, wherein when the safety selector is in the first position, the first engaging surface of the pin is in contact with the first disconnector thereby preventing movement of the first disconnector and the second engaging surface of the pin is in contact with the second disconnector thereby preventing movement of the second disconnector.

6. The trigger assembly of claim 5, wherein when the safety selector is in the second position, the first engaging surface of the pin is in contact with the first disconnector thereby preventing movement of the first disconnector and the second engaging surface of the pin is not in contact with the second disconnector thereby permitting movement of the second disconnector, wherein the second disconnector sear surface will contact the hammer second sear surface when the trigger assembly is pulled thereby completing the first stage, and wherein when the trigger assembly is pulled during the second stage, the hammer second sear surface will force the second disconnector downwardly overcoming the spring force of the second disconnector spring until the point where the hammer first sear surface no longer engages the trigger sear thereby completing the second stage, the hammer will then rotate to the second position.

7. The trigger assembly of claim 6, wherein when the safety selector is in the third position, the first engaging surface of the pin is not in contact with the first disconnector thereby permitting movement of the first disconnector and the second engaging surface of the pin is in contact with the second disconnector thereby preventing movement of the second disconnector, wherein the first disconnector sear surface will contact the hammer second sear surface when the trigger assembly is pulled thereby completing the first stage, and wherein when the trigger assembly is pulled during the second stage, the hammer second sear surface will force the first disconnector downwardly overcoming the spring force of the first disconnector spring until the point where the hammer first sear surface no longer engages the trigger sear thereby completing the second stage, the hammer will then rotate to the second position.

8. The trigger assembly of claim 7, wherein the hammer further defines a notch and the trigger base defines an edge at the forward end of the trigger base, wherein the edge of the trigger base engages the notch of the hammer when the hammer is in the first position.

9. The trigger assembly of claim 8, wherein the edge of the trigger base disengages the notch of the hammer at the end of the second stage, thereby permitting the hammer to move to the second position.

10. The trigger assembly of claim 1, further comprising an over-travel set screw mounted to the forward end of the trigger base and extending through the trigger base.

11. The trigger assembly of claim 1, wherein the first disconnector spring defines a first spring weight, and the second disconnector spring defines a second spring weight, and wherein the first spring weight is different than the second spring weight.

12. A firearm that includes the trigger assembly of claim 1.

13. A trigger assembly for a firearm comprising:

a hammer defining a hammer first sear surface and a hammer second sear surface, a trigger mountable to the firearm by a trigger pin, the trigger rotatable around the trigger pin through a first stage and a second stage, the trigger defining a trigger base having a floor, a forward end and a rearward end, the trigger base defining a trigger sear extending upwardly from the forward end, the trigger sear defining a hook shape that extends toward the rearward end of the trigger base, wherein the trigger sear is capable of engaging the hammer first sear surface, a plurality of disconnectors mountable to the trigger pin, each of the plurality of disconnectors defining an aperture for receiving a screw, a plurality of disconnector springs positioned between the screws mounted to the disconnectors and the floor of the trigger base, wherein each of the plurality of disconnectors define a disconnector sear surface, wherein the trigger base defines opposing side walls and opposing columns extending upwardly from the trigger base floor, the opposing columns joined by a transversely extending bridge that extends over and above the plurality of disconnectors, threaded screws coupled to the bridge and that extend downwardly toward and in contact with the disconnectors positioned beneath the bridge to set the position of the disconnectors relative to the hammer second sear surface.

14. The trigger assembly of claim 13, further comprising a safety selector mountable to the firearm, the safety selector movable between a plurality of positions.

15. The trigger assembly of claim 14, wherein the safety selector defines a lever accessible from a side of the firearm, the safety selector also including a pin extending across and above the plurality of disconnectors, wherein the pin defines a plurality of engaging surfaces capable of engaging the plurality of disconnectors.

16. The trigger assembly of claim 15, wherein when one of the plurality engaging surfaces of the pin engages with one of the disconnectors, another of the plurality of engaging surfaces is not in contact with another of the disconnectors thereby permitting movement of that disconnector.

17. The trigger assembly of claim 13, wherein the hammer further defines a notch and the trigger base defines an edge at the forward end of the trigger base, wherein the edge of the trigger base engages the notch of the hammer when the hammer is in a first position.

18. The trigger assembly of claim 17, wherein when the trigger is moved from a first position to a second position the edge of the trigger base disengages the notch of the hammer, thereby permitting the hammer to move to a second position.

19. A firearm that includes the trigger assembly of claim 13.

* * * * *